US008485513B2

(12) United States Patent
Sugimoto et al.

(10) Patent No.: US 8,485,513 B2
(45) Date of Patent: Jul. 16, 2013

(54) SYSTEM FOR CALCULATING SPINE JACKET WIDTH

(75) Inventors: Kunihiko Sugimoto, Yawata (JP); Tsuyoshi Morimoto, Itami (JP); Atsushi Ito, Yawata (JP); Taro Yamamoto, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 630 days.

(21) Appl. No.: 12/363,276

(22) Filed: Jan. 30, 2009

(65) Prior Publication Data

US 2009/0306809 A1 Dec. 10, 2009

(30) Foreign Application Priority Data

Jun. 10, 2008 (JP) ..... 2008-152089

(51) Int. Cl.
*B65H 37/04* (2006.01)

(52) U.S. Cl.
USPC ..... 270/58.09; 270/52.18; 270/58.07; 270/58.08

(58) Field of Classification Search
USPC ..... 270/52.18, 58.07, 58.08, 58.09; 412/4, 412/14, 18, 19, 33
See application file for complete search history.

(56) References Cited

U.S. PATENT DOCUMENTS

| | | | | |
|---|---|---|---|---|
| 6,070,023 | A | 5/2000 | Kataoka | |
| 7,920,820 | B2 * | 4/2011 | Kitta et al. | 399/408 |
| 2002/0089111 | A1 | 7/2002 | Tsuchiya et al. | |
| 2007/0098525 | A1 | 5/2007 | Awano | |
| 2008/0237962 | A1 * | 10/2008 | Kubota et al. | 270/21.1 |
| 2008/0240887 | A1 * | 10/2008 | Gotoh et al. | 412/4 |
| 2009/0160115 | A1 * | 6/2009 | Iguchi et al. | 270/58.09 |

FOREIGN PATENT DOCUMENTS

| | | | |
|---|---|---|---|
| JP | 07-117377 | | 5/1995 |
| JP | 10-167557 | | 6/1998 |
| JP | 2002-200862 | A | 7/2002 |
| JP | 2002-283767 | A | 10/2002 |
| JP | 2002-283769 | A | 10/2002 |
| JP | 2006-172306 | A | 6/2006 |
| JP | 2007-106538 | | 4/2007 |
| JP | 2007-136867 | | 6/2007 |
| JP | 2007-168353 | | 7/2007 |
| JP | 2007-178967 | | 7/2007 |
| JP | 2008-037057 | | 2/2008 |
| JP | 2008-048185 | | 2/2008 |

OTHER PUBLICATIONS

Notice of Grounds of Rejection issued in the corresponding Japanese Patent Application No. 2008-152089 dated Jan. 26, 2010, and an English Translation thereof.

* cited by examiner

*Primary Examiner* — Leslie A Nicholson, III
(74) *Attorney, Agent, or Firm* — Buchanan Ingersoll & Rooney PC

(57) ABSTRACT

A control apparatus obtains information identifying sheets stored in an MFP to be caused to perform printing for printing a printed object to be subjected to jacketed book binding, wherein this information is stored in the MFP. The control apparatus stores thicknesses of respective paper sheets as information about paper sheets. From this information and from the information obtained from the MFP, the control apparatus creates a table indicative of the correspondence between the respective paper sheets stored in the MFP and their thicknesses. Further, on receiving a selection of paper sheets to be used for printing for the printed object and a number of these paper sheets, the control apparatus determines a thickness of each paper sheet by making a reference to the table and calculates the spine jacket width by multiplying the thickness by the number of paper sheets.

14 Claims, 9 Drawing Sheets

FIG. 2

| NUMBER | NAME | SORT OF PAPER SHEET | BASIS WEIGHT | PAPER COLOR | PRESENCE OR ABSENCE OF HOLES |
|---|---|---|---|---|---|
| 1 | KM Print Shop 1 | Plain | 68g/m2 | WHITE | PRESENCE |
| 2 | KM Print Shop 2 | CoatedA | 81g/m2 | WHITE | PRESENCE |
| 3 | KM Print Shop 3 | Thick1 | 157g/m2 | WHITE | PRESENCE |
| 4 | KM Print Shop 4 | Thin | 52g/m2 | WHITE | PRESENCE |
| 5 | | | | | |
| 6 | | | | | |
| 7 | | | | | |
| 8 | | | | | |
| 9 | | | | | |
| 10 | | | | | |

FIG. 3

| TYPE OF PAPER SHEET | | THICKNESS OF PAPER SHEET [mm] | TYPE OF PAPER SHEET | | THICKNESS OF PAPER SHEET [mm] |
|---|---|---|---|---|---|
| SORT OF PAPER SHEET | BASIS WEIGHT | | SORT OF PAPER SHEET | BASIS WEIGHT | |
| Plain | 60g/m2 | 0.075mm | Thick1 | 60g/m2 | 0.097mm |
| | 61g/m2 | 0.076mm | | 61g/m2 | 0.099mm |
| | 62g/m2 | 0.078mm | | 62g/m2 | 0.100mm |
| | 63g/m2 | 0.079mm | | 63g/m2 | 0.102mm |
| | 64g/m2 | 0.080mm | | 64g/m2 | 0.104mm |
| | 65g/m2 | 0.082mm | | 65g/m2 | 0.106mm |
| | 66g/m2 | 0.083mm | | 66g/m2 | 0.107mm |
| | 67g/m2 | 0.084mm | | 67g/m2 | 0.109mm |
| | 68g/m2 | 0.085mm | | 68g/m2 | 0.111mm |
| | 69g/m2 | 0.086mm | | 69g/m2 | 0.112mm |
| | 70g/m2 | 0.088mm | | 70g/m2 | 0.114mm |
| | 71g/m2 | 0.089mm | | 71g/m2 | 0.115mm |
| | 78g/m2 | | | 78g/m2 | |
| | 79g/m2 | 0.098mm | | 79g/m2 | 0.128mm |
| | 80g/m2 | 0.100mm | | 80g/m2 | 0.130mm |
| | 81g/m2 | 0.101mm | | 81g/m2 | 0.131mm |
| | 82g/m2 | 0.102mm | | 82g/m2 | 0.133mm |
| | 83g/m2 | 0.103mm | | 83g/m2 | 0.134mm |
| | 84g/m2 | 0.105mm | | 84g/m2 | 0.137mm |
| | 85g/m2 | 0.106mm | | 85g/m2 | 0.138mm |
| | 86g/m2 | 0.108mm | | 86g/m2 | 0.140mm |
| | 155g/m2 | 0.193mm | | 155g/m2 | 0.251mm |
| | 156g/m2 | 0.195mm | | 156g/m2 | 0.254mm |
| | 157g/m2 | 0.196mm | | 157g/m2 | 0.255mm |
| | 158g/m2 | 0.197mm | | 158g/m2 | 0.256mm |
| | 159g/m2 | 0.198mm | | 159g/m2 | 0.257mm |
| | 160g/m2 | 0.200mm | | 160g/m2 | 0.260mm |
| | 161g/m2 | 0.201mm | | 161g/m2 | 0.261mm |
| | 162g/m2 | 0.202mm | | 162g/m2 | 0.263mm |
| | 163g/m2 | 0.204mm | | 163g/m2 | 0.265mm |
| | 164g/m2 | 0.205mm | | 164g/m2 | 0.267mm |
| | 165g/m2 | 0.206mm | | 165g/m2 | 0.268mm |
| CoatedA | 60g/m2 | 0.090mm | Thin | 50g/m2 | 0.073mm |
| | 61g/m2 | 0.091mm | | 51g/m2 | 0.074mm |
| | 62g/m2 | 0.093mm | | 52g/m2 | 0.075mm |
| | 63g/m2 | 0.095mm | | 53g/m2 | 0.077mm |
| | 64g/m2 | 0.096mm | | 54g/m2 | 0.078mm |
| | 65g/m2 | 0.098mm | | 55g/m2 | 0.079mm |
| | 66g/m2 | 0.099mm | | 56g/m2 | 0.081mm |
| | 67g/m2 | 0.101mm | | 57g/m2 | 0.082mm |
| | 68g/m2 | 0.102mm | | 58g/m2 | 0.084mm |
| | 69g/m2 | 0.104mm | | 59g/m2 | 0.085mm |
| | 70g/m2 | 0.105mm | | 60g/m2 | 0.086mm |
| | 71g/m2 | 0.107mm | | 61g/m2 | 0.088mm |
| | 78g/m2 | | | 78g/m2 | |
| | 79g/m2 | 0.118mm | | 79g/m2 | 0.109mm |
| | 80g/m2 | 0.120mm | | 80g/m2 | 0.110mm |
| | 81g/m2 | 0.121mm | | 81g/m2 | 0.111mm |
| | 82g/m2 | 0.122mm | | 82g/m2 | 0.112mm |
| | 83g/m2 | 0.124mm | | 83g/m2 | 0.113mm |
| | 84g/m2 | 0.126mm | | 84g/m2 | 0.116mm |
| | 85g/m2 | 0.127mm | | 85g/m2 | 0.117mm |
| | 86g/m2 | 0.130mm | | 86g/m2 | 0.119mm |
| | 155g/m2 | 0.232mm | | 155g/m2 | 0.212mm |
| | 156g/m2 | 0.234mm | | 156g/m2 | 0.215mm |
| | 157g/m2 | 0.235mm | | 157g/m2 | 0.216mm |
| | 158g/m2 | 0.236mm | | 158g/m2 | 0.217mm |
| | 159g/m2 | 0.238mm | | 159g/m2 | 0.218mm |
| | 160g/m2 | 0.240mm | | 160g/m2 | 0.220mm |
| | 161g/m2 | 0.241mm | | 161g/m2 | 0.221mm |
| | 162g/m2 | 0.242mm | | 162g/m2 | 0.222mm |
| | 163g/m2 | 0.245mm | | 163g/m2 | 0.224mm |
| | 164g/m2 | 0.246mm | | 164g/m2 | 0.226mm |
| | 165g/m2 | 0.247mm | | 165g/m2 | 0.227mm |

| TYPE OF PAPER SHEET | | THICKNESS OF PAPER SHEET |
|---|---|---|
| SORT OF PAPER SHEET | BASIS WEIGHT | |
| Plain | 68g/m2 | 0.085mm |
| CoatedA | 81g/m2 | 0.121mm |
| Thick1 | 157g/m2 | 0.255mm |
| Thin | 52g/m2 | 0.075mm |

SYSTEM FOR CALCULATING SPINE JACKET WIDTH

This application is based on Japanese Patent Application No. 2008-152089 filed with the Japan Patent Office on Jun. 10, 2008, the entire content of which is hereby incorporated by reference.

BACKGROUND OF THE INVENTION

1. Field of the Invention

The present invention relates to a control apparatus, a spine-jacket-width calculation system, a spine-jacket-width calculating method and a storage medium storing a spine-jacket-width calculating program and, more particularly, relates to a control apparatus, a spine-jacket-width calculation system, a spine-jacket-width calculating method and a storage medium storing a spine-jacket-width calculating program which calculate a spine jacket width required for performing jacketed-book binding.

2. Description of Related Art

There are image forming apparatuses having the function of performing bookbinding by applying an adhesive paste to one sides of plural printed objects and enwrapping them in a single paper sheet as a jacket, in addition to post-processing such as punching and stapling, as post-processing for printed objects which are outputted printed paper sheets. This bookbinding is referred to as "case binding".

The jacket used for case binding is constituted by a front jacket positioned on the upper surface of the bound book, a back jacket positioned on the back surface of the same, and a spine jacket positioned on the spine portion constituted by the aforementioned sides to which the adhesive paste has been applied. Hereinafter, for ease of description, the direction along the aforementioned side of the printed object to which the adhesive paste has been applied is a longitudinal direction, while the direction along the sides orthogonal to the side to which the adhesive paste has been applied is a lateral direction. In other words, it is assumed that the side of the printed object resulted from the bookbinding along its spine portion and the side of the printed resulted from the bookbinding along its spine portion and the side of the printed object along its opening portion are the longitudinal sides of the printed object, while the sides of the printed object along its top and the bottom portions are the lateral sides of the printed object. Similarly, it is assumed that the sides of the jacket which are parallel to the longitudinal sides of the printed object are the longitudinal sides of the jacket, while the sides of the jacket which are parallel to the lateral sides of the printed object are the lateral sides of the jacket.

In some cases, an image forming apparatus having a bookbinding function performs printing for jackets. In this case, the sizes of paper sheets for use in printing for jackets, namely the longitudinal and lateral lengths of the paper sheets are one of important factors.

The length of the longitudinal sides of a jacket is determined by the length of the longitudinal sides of the printed object to be subjected to case binding. For example, the length of the longitudinal sides of the jacket is determined to be the same length as that of the longitudinal sides of the printed object to be subjected to the case binding or to be the same length thereas plus a predetermined length. The length of the lateral sides of the jacket (namely the width) is determined by the sum of the length of the lateral sides of the front jacket portion (referred to as a front jacket width), the length of the lateral sides of the back jacket portion (referred to as a back jacket width) and the length of the lateral sides of the spine jacket portion (referred to as a spine jacket width).

Out of the front jacket width, the back jacket width and the spine jacket width, the front jacket width and the back jacket width are determined by the length of the lateral sides of the printed object to be subjected to the case binding. For example, the front jacket width and the back jacket width are determined to be the same length as that of the lateral sides of the printed object to be subjected to the case binding or to be the same length thereas plus a predetermined length. However, the spine jacket width depends on the thickness of the printed object to be subjected to the case binding. Accordingly, there is a need for accurately calculating a thickness of the printed object to be subjected to the case binding.

As a method for calculating a spine jacket width, Japanese Laid-Open Patent Publication No. 2006-172306 discloses an information processing apparatus which preliminarily stores correspondence between "types" of printing paper sheets and the thicknesses of the printing paper sheets, obtains the thickness of printing paper sheets from the "type" of printing paper sheets specified by a user and calculates a spine jacket width by multiplying the obtained thickness by a number of printing paper sheets specified by the user.

However, with the spine-jacket calculating method disclosed in the document, the thickness of printing paper sheets used therein is a value which has been preliminarily stored in the information processing apparatus in association with the "type" of printing paper sheets and, therefore, is not the thickness of printing paper sheets which are actually stored in a printing apparatus. Accordingly, in a case where the printing apparatus stores printing paper sheets of types different from that of printing paper sheets specified through the information processing apparatus, the thickness of the printed object to be subjected to case binding becomes different from the calculated spine jacket width.

Further, in a case where a printed object to be subjected to case binding is constituted by plural sorts of printing paper sheets, namely in a case where a job for printing for creating a printed object to be subjected to case binding is constituted by plural sorts of printing paper sheets, it is impossible to obtain the spine jacket width with the spine-jacket calculating method disclosed in the document.

If the width of the jacket to be used for case binding, particularly the spine jacket width, is not accurately calculated, this will induce problems as follows.

Namely, as a first problem, if case binding is performed using a printed jacket, the width of the jacket will not conform to the sum of the width of the front jacket portion of the printed object the width of the back jacket portion of the printed object and the thickness of the printed object to be subjected to case binding. This will induce the problem that the position of the printed jacket is deviated from a correct position, thereby resulting in an unbeautiful product.

In a case where an image forming apparatus is caused to perform printing for a jacket for use in case binding, a user creates image data in such a way that the image data conforms to a calculated width of a printing paper sheet and specifies the created image data as image data to be used for printing for the jacket through the image forming apparatus. For example, it is assumed that the front jacket width, the spine jacket width and the back jacket width are determined through calculations to be 200 mm, 20 mm and 200 mm, respectively, and the user creates image data for use in printing for a jacket on the assumption that the width is 420 mm, based on the result of the aforementioned calculations. In a case where the actual spine jacket width conforms to the spine jacket width of 20 mm resulted from the calculation as illustrated in FIG. 8A, if the aforementioned image data for use in printing for the jacket is printed on a printing paper sheet with a width based on the actual spine jacket width, the printing for the jacket is attained at a state where the width of the printing paper sheet conforms to the width of the image data, as illustrated in FIG. 8B. However, in a case where the actual spine jacket width is smaller than the spine jacket width of 20 mm resulted from the calculation as being represented as 10 mm in FIG. 9A, if the aforementioned image data for use in printing for the jacket is printed on a printing paper sheet with a width based on the actual spine jacket width, the width of the printing paper sheet is smaller than the width of the image data, thereby resulting in printing for the jacket at a state where a portion of the image data is chipped, as represented as a portion A in FIG. 9B. On the contrary, in a case where the actual spine jacket width is larger than the spine jacket width of 20 mm resulted from the calculation as being represented as 30 mm in FIG. 10A, if the aforementioned image data for use in printing for the jacket is printed on a printing paper sheet with a width based on the actual spine jacket width, the width of the printing paper sheet is larger than the width of the image data, thereby resulting in printing for the jacket at a state where there exists an redundant space on the printing paper sheet, as represented as a portion B in FIG. 10B. Namely, as a second problem, there will be induced the problem that the image data for use in printing for the jacket can not be properly printed on the printing paper sheet.

SUMMARY OF THE INVENTION

The present invention was made in view of the problems and aims at providing a control apparatus, a spine-jacket-width calculation system, a spine-jacket-width calculating method and a storage medium storing a spine-jacket-width calculating program which are capable of accurately calculating spine jacket widths.

In order to attain the object, a control apparatus according to an aspect of the present invention is a control apparatus which controls an image forming apparatus having the function of performing spine-jacketed book binding processing on a printed object, the control apparatus including: a storage unit which stores correspondence information indicative of the correspondence between information identifying printing paper sheets and a thicknesses of the printing sheets; an obtaining unit which obtains information identifying stored printing paper sheets, from the image forming apparatus; a reception unit which receives a selection of printing paper sheets for use in printing image data and a number of the selected printing paper sheets to be used for printing, out of the information identifying the stored printing paper sheets which has been obtained from the image forming apparatus by the obtaining unit; an identification unit which identifies a thickness of the selected printing paper sheets, the selection of which having been received by the reception unit; a calculation unit which calculates a spine jacket width in performing jacketed-book binding processing on the printed object resulted from printing the image data on the printing paper sheets, based on the value resulted from multiplication of the thickness of the printing paper sheets identified by the identification unit by the number of paper sheets to be used for printing which has been received by the reception unit; and an output unit which outputs, to the image forming apparatus, a control signal including the spine jacket width calculated by the calculation unit.

A spine-jacket-width calculation system according to another aspect of the present invention is a system including an image forming apparatus and a control apparatus which controls the image forming apparatus, the image forming apparatus including: a storage unit which stores information identifying stored printing paper sheets; and a post-processing unit which performs spine-jacketed book binding processing on a printed object, according to a control signal from the control apparatus; wherein the control unit includes a storage unit which stores correspondence information indicative of the correspondence between information identifying printing paper sheets and a thicknesses of the printing paper sheets, an obtaining unit which obtains the information identifying the printing paper sheets stored in the image forming apparatus which is stored in the storage unit in the image forming apparatus, a reception unit which receives a selection of printing paper sheets for use in printing image data and a number of the selected printing paper sheets to be used for printing, out of the information identifying the printing paper sheets stored in the image forming apparatus which has been obtained by the obtaining unit, an identification unit which identifies a thickness of the selected printing paper sheets, the selection of which having been received by the reception unit, a calculation unit which calculates a spine jacket width in performing jacketed-book binding processing on the printed object resulted from printing the image data on the printing paper sheets, based on the value resulted from multiplication of the thickness of the printing paper sheets identified by the identification unit by the number of paper sheets to be used for printing which has been received by the reception unit, and an output unit which outputs, to the image forming apparatus, a control signal including the spine jacket width calculated by the calculation unit.

According to another aspect of the present invention, there is provided a storage medium storing a program for causing a computer to execute calculations for a spine jacket width included in the width of a jacket to be used in performing spine-jacketed book binding processing on a printed object: wherein the computer includes a storage unit which stores correspondence information indicative of the correspondence between information identifying printing paper sheets and a thicknesses of the printing paper sheets, and the program causes the computer to execute the steps of obtaining information identifying printing paper sheets stored in an image forming apparatus to be caused to perform the book binding processing, receiving a selection of printing paper sheets for use in printing image data and a number of the selected printing paper sheets to be used for printing, out of the information identifying the printing paper sheets stored in the image forming apparatus, reading at least a thickness of the selected printing paper sheets, from the storage unit, identifying the thickness of the selected printing paper sheets, and calculating a spine jacket width in performing jacketed-book binding processing on the printed object resulted from printing the image data on the printing paper sheets, based on the value resulted from multiplication of the identified thickness of the printing paper sheets by the received number of paper sheets to be used for printing.

A spine-jacket-width calculation method according to another aspect of the present invention is a method for calculating a spine jacket width with a control apparatus which controls an image forming apparatus having a function of performing spine-jacketed book binding processing on a printed object: wherein the control apparatus includes a storage unit which stores correspondence information indicative of the correspondence between information identifying printing paper sheets and a thicknesses of the printing paper sheets, and the calculating method includes the steps of obtaining information identifying printing paper sheets stored in an image forming apparatus to be caused to perform the book binding processing, receiving a selection of printing paper sheets for use in printing image data and a number of the selected printing paper sheets to be used for printing, out of the information identifying the printing paper sheets stored in the image forming apparatus, reading at least a thickness of the selected printing paper sheets, from the storage unit, identifying the thickness of the selected printing sheets, and calculating a spine jacket width in performing jacketed-book binding processing on the printed object resulted from printing the image data on the printing paper sheets, based on the value resulted from multiplication of the identified thickness of the printing paper sheets by the received number of paper sheets to be used for printing.

With the present invention, it is possible to accurately calculate the width of a spine jacket for use in performing case binding on a printed object with an image forming apparatus, which enables attaining beautiful case binding.

The foregoing and other objects, features, aspects and advantages of the present invention will become more apparent from the following detailed description of the present invention when taken in conjunction with the accompanying drawings.

BRIEF DESCRIPTION OF DRAWINGS

FIG. 2 is a diagram illustrating a concrete example of a paper catalogue which is information about respective paper sheets stored in an MFP included in the system according to the embodiment of the present invention.

FIG. 3 is a diagram illustrating a concrete example of information about printing paper sheets which is stored in a PC included in the system according to the embodiment of the present invention.

DESCRIPTION OF THE PREFERRED EMBODIMENTS

Figure 1A:
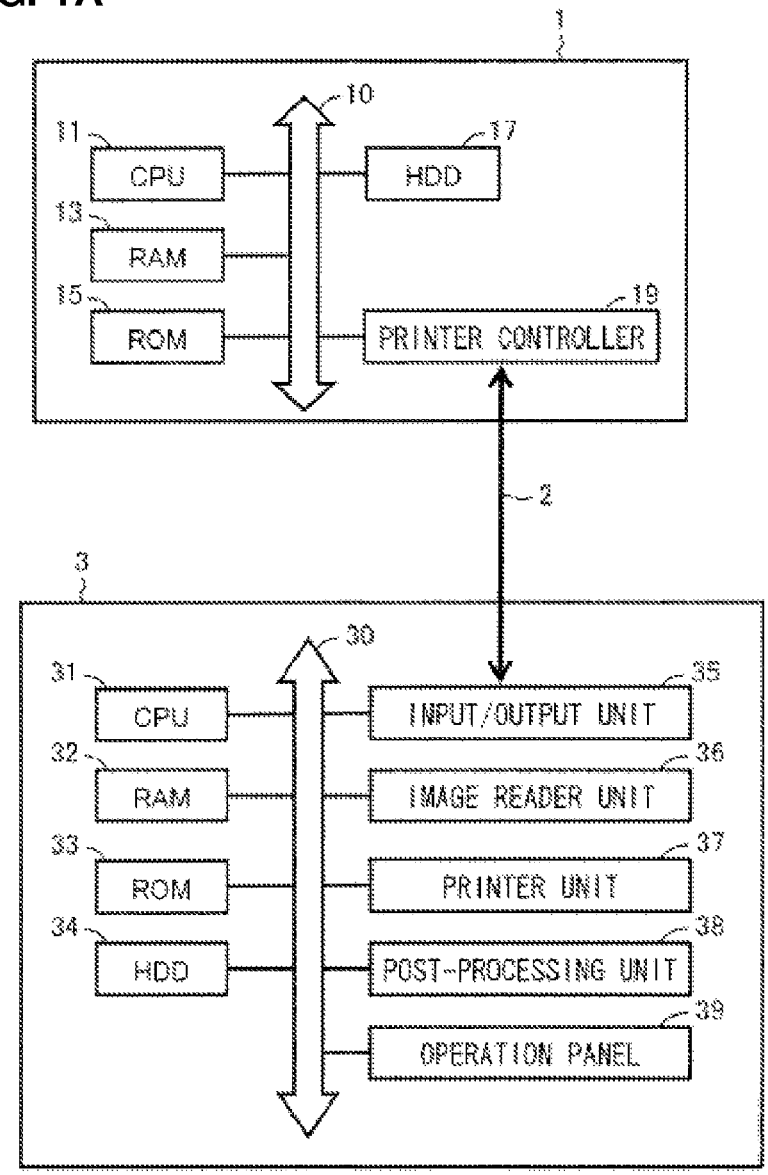
FIGS. 1A and 1B are block diagrams illustrating a concrete example of a system structure and hardware structures of devices included in the system, according to an embodiment of the present invention.

With reference to the drawings, an embodiment of the present invention will be described, hereinafter. In the following description, the same members and the same components will be designated by the same reference characters and also have the same names and functions.

Figure 1B:
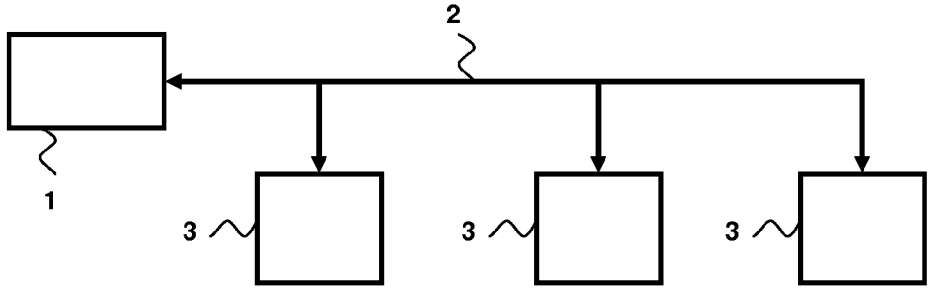

Referring to FIG. 1A, a system according to the present embodiment includes an MFP (Multi Function Peripheral) 3 as a concrete example of an image forming apparatus, and a personal computer (hereinafter, referred to as a PC) as a concrete example of a control apparatus which controls the image forming apparatus, wherein they are connected to each other through a network 2. Network 2 can either be a wired network such as a dedicated line or be a conceptually represented wireless communication. Further, the system can include plural image forming apparatuses as illustrated in FIG. 1B.

Further, referring to FIG. 1A, PC 1 as the control apparatus can be constituted by a common PC. A concrete example of the hardware structure thereof includes a CPU (Central Processing Unit) 11, a RAM (Random Access Memory) 13, a ROM (Read Only Memory) 15, an HDD (Hard Disk Drive) 17, a display unit 16, an input unit 18 and a printer controller 19. These components communicate with one another through a bus 10.

Further, referring to FIG. 1A, a concrete example of the hardware structure of MFP 3 as the image forming apparatus includes a CPU 31, a RAM 32, a ROM 33, an HDD 34, an input/output unit 35, an image reader unit 36, a printer unit 37, a post-processing unit 38, and an operation panel 39. These components communication with one another through a bus 30.

Input unit 18 in PC 1 includes input devices such as a keyboard and a mouse, and these input devices input, to CPU 11 through bus 10, operation signals corresponding to operations performed by a user. CPU 11 reads and executes programs stored in storage devices such as RAM 13 and ROM 15, according to the operation signals, and outputs control signals through bus 10 for controlling entire PC 1. The storage devices which are RAM 13, ROM 15 and HDD 17 store various types of information, in addition to the programs.

Display unit 16 includes a display device such as a display and executes processing for displaying predetermined information on the display device according to the control signals to display the information on the display device. Printer controller 19 executes processing for controlling MFP 3 according to the control signals to output control signals to MFP 3 through network 2. Further, printer controller 19 obtains information required for the processing from MFP 3 through network 2.

Input/output unit 35 in MFP 3, which is connected to network 2, receives the control signals from PC 1 and inputs them to CPU 31. Further, input/output unit 35 receives required information from CPU 31 which has obtained the required information according to the control signals and output it to PC 1.

CPU 31 reads and executes programs stored in storage devices such as RAM 32 and ROM 33 according to operation signals from operation panel 39 and signals inputted from the input/output unit 35 to output control signals through bus 30 for controlling entire MFP 3. The storage devices which are RAM 32, ROM 33 and HDD 34 store various types of information, in addition to the programs.

Image reader unit 36 scans over a document set on a document table which is not illustrated for creating image data, according to the control signals. Printer unit 37 performs processing for printing specified image data on printing paper sheets according to the control signals. Operation panel 39, which corresponds to a touch type panel, displays screen pages according to the control signals. Further, operation panel 39 receives user's operations and inputs operation signals corresponding thereto to CPU 31 through bus 30. Post-processing unit 38 executes post-processing on the printing paper sheets on which the image data has been printed by printer unit 37, according to the control signals. Post-processing unit 38 performs, for example, punching processing for forming holes at specified positions or stapling processing for binding plural printing paper sheets with staples. In the present invention, post-processing unit 38 performs jacketed-book binding processing as post-processing. More specifically, the jacketed-book binding processing refers to processing for stacking, in a specified direction, plural printing paper sheets which have been subjected to printing, then applying an adhesive paste to one sides of them and enwrapping them in a single paper sheet as a jacket for binding them into a book. This bookbinding is referred to as "case binding". Further, the case-binding processing and the concrete apparatus structure of post-processing unit 38 for performing the case-binding processing are not limited to a certain processing method and a certain apparatus structure, in the present invention.

The information stored in the storage devices which are RAM 32, ROM 33 and HDD 34 includes information about the printing paper sheets stored in a paper-sheet storage unit which is not illustrated, in MFP 3. More specifically, as illustrated in FIG. 2, there is stored information about the names, the sorts, the basis weights and the colors of the respective stored paper sheets and the presence and absence of holes in these respective stored paper sheets. The information about the printing paper sheets stored in the paper-sheet storage unit will be referred to as "Paper Catalogue", in the following description. For example, a user such as a manager of the system registers the paper catalogue with a predetermined area in RAM 32 or HDD 34, by operating operation panel 39 and the like. Further, the content of the stored paper catalogue can be changed through operations performed by specific users or specific operations. Further, the information included in the paper catalog is not limited to the information about the names, the sorts, the basis weights, the colors of the paper sheets and the presence or absence of holes in the paper sheets, and the information included in the paper catalogue can also include other information. Also, the information included in the paper catalog is not necessarily required to include all of the information and is only required to include at least information identifying the printing paper sheets. The information identifying the printing paper sheets can be, for example, the combination of the sorts and the basis weights of the printing paper sheets, out of the sorts and the basis weights of the printing paper sheets and information about the printing paper sheets. The information identifying the printing paper sheets will be referred to as "types" of the printing paper sheets.

The information stored in the storage devices which are RAM 13, ROM 15 and HDD 17 includes information about printing paper sheets. More specifically, as illustrated in FIG. 3, there is stored information about the sorts, the basis weights and the thicknesses of respective printing paper sheets. In other words, there are stored the thicknesses of printing paper sheets of respective types. The information about printing paper sheets will be referred to as "Paper-Sheet Information", in the following description. The paper-sheet information is preliminarily stored in predetermined areas in the storage devices. The paper-sheet information can be changed or increased through operations by specific users or specific operations. Further, the information included in the paper-sheet information is not limited to aforementioned information about the sorts, the basis weights and the thicknesses of printing paper sheets which can be possibly used in the connected MFP 3. The information included in the sheet information can include at least the aforementioned information and also can include, in addition thereto, other information. Further, in the example illustrated in FIG. 3, the thicknesses of printing paper sheets of respective sorts are stored with a basis-weight interval of 1 g/m$^2$. However, it is not necessary that their thicknesses are stored with a basis-weight interval of 1 g/m$^2$, and their thicknesses can be stored with a basis-weight interval larger than 1 g/m$^2$, such as a basis-weight interval of 3 g/m$^2$. In this case, when processing which will be described later requires information about the thickness of printing paper sheets having a basis weight corresponding to a thickness which is not stored therein, CPU 11 calculates the required thickness to attain interpolation, using the information about the thicknesses stored in association with the basis weights previous and subsequent to this basis weight.

With reference to a concrete example, there will be described an example of the aforementioned interpolation method. For example, it is assumed that the paper catalogue stores information about paper sheets of a sheet type "Plain" which has a basis weight of 68 g/m$^2$. In the case where the information stored in the storage devices is that illustrated in FIG. 3, the storage devices store no information about the aforementioned paper sheets. In this case, CPU 11 reads a thickness of 0.0085 mm of paper sheets with a basis weight of 68 g/m$^2$ and a thickness of 0.0086 mm of paper sheets with a basis weight of 69 g/m$^2$, out of the stored information illustrated in FIG. 3 and, then, executes the following operations to determine a thickness of paper sheets of the aforementioned sheet type "Plain" which has a basis weight of 68 g/m$^2$ to be 0.0855 mm.

$$(0.0086-0.0085)/(69-68)=0.001$$

$$\text{The paper sheet thickness}=0.0085+(0.001\times 0.5)=0.0855\ \text{mm}$$

Further, there has been exemplified an interpolation method using an average, the interpolation method is not limited to a method using an average, and the interpolation method can be other methods such as least squares approximation.

Figure 4:
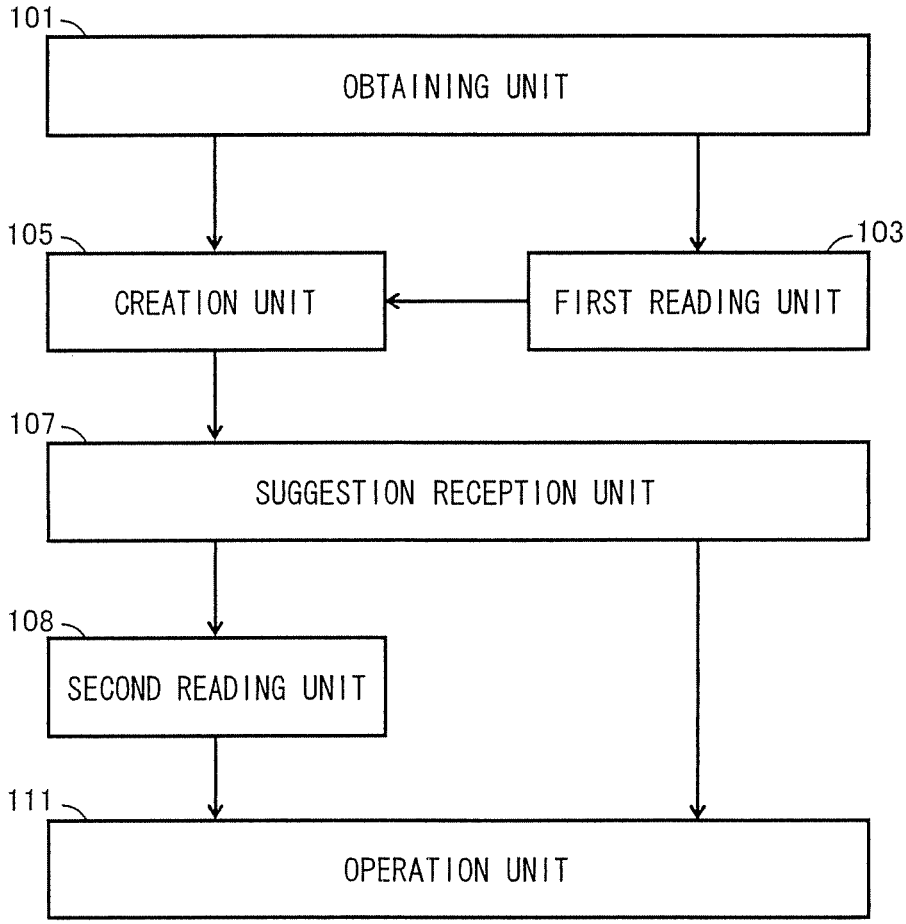
FIG. 4 is a block diagram illustrating a concrete example of the structure of a printer controller in the PC included in the system according to the embodiment of the present invention.

Printer controller 19 in PC 1 illustrated in FIG. 4 is mainly structured to operate according to control signals, wherein CPU 11 outputs these control signals by reading and executing programs stored in the storage devices such as RAM 13. However, at least a portion of printer controller 19 can be constituted by other hardware structures in PC 1, such as CPU 11.

Referring to FIG. 4, printer controller 19 includes an obtaining unit 101, a first reading unit 103, a creation unit 105, a suggestion reception unit 107, a second reading unit 108, and an operation unit 111.

Obtaining unit 111 obtains information indicative of the types of printing paper sheets, out of the paper catalogue stored in the predetermined areas in the storage devices in MFP 3, from MFP 3 through network 2 and, then, inputs the obtained information to first reading unit 103 and creation unit 105. First reading unit 103 reads information corresponding to the information inputted from obtaining unit 101, out of the paper-sheet information stored in the storage devices such as RAM 13, and inputs the read information to creation unit 105. Based on the information inputted from obtaining unit 101 and the information inputted from first reading unit 103, creation unit 105 creates information about the printing paper sheets stored in the paper-sheet storage unit in MFP 3 and stores the created information in predetermined areas in the storage devices such as RAM 13. Also, the information created by creation unit 105 can be inputted to suggestion reception unit 107. With reference to a concrete example, the information created by creation unit 105 will be described, in detail.

Suggestion reception unit 107 reads the aforementioned information from the predetermined areas of the storage devices or receives an input of the aforementioned information from creation unit 105 and then performs processing for displaying, on display unit 16, an operation screen page based on this information. Further, suggestion reception unit 107 receives operation signals inputted from input unit 18 as a result of operations performed on input unit 18 at the timing when the operation screen page is being displayed on display unit 16 and, then, inputs signals indicative of the contents of the operations to second reading unit 108 and operation unit 111.

Second reading unit 108 reads information corresponding to the signals inputted from suggestion reception unit 107, out of the aforementioned information which has been created by creation unit 105 and stored in the predetermined areas of the storage devices, and inputs the read information to operation unit 111. Operation unit 111 performs operations using the signals inputted from suggestion reception unit 107 and the information inputted from second reading unit 108.

The operations performed by operation unit 111 include operations for calculating the sizes of a printing paper sheet required for performing printing, with MFP 3, for a jacket to be used for case binding, which is the post-processing to be performed by post-processing unit 38 in MFP 3. As described above, a jacket to be used for case binding is constituted by a front jacket positioned on the upper surface of a bound book, a back jacket positioned on the back surface of the same, and a spine jacket positioned on the spine portion constituted by the side to which the adhesive paste has been applied. Hereinafter, for ease of description, the direction along the side of the printed object to which the adhesive paste has been applied is a longitudinal direction, while the direction along the sides orthogonal to the side to which the adhesive paste has been applied is a lateral direction. In other words, it is assumed that the side of the printed object resulted from the bookbinding along its spine portion and the side of the printed object along its opening portion are the longitudinal sides of the printed object, while the sides of the printed object along its top and the bottom portions are the lateral sides of the printed object. Similarly, it is assumed that the sides of the jacket which are parallel to the longitudinal sides of the printed object are the longitudinal sides of the jacket, while the sides of the jacket which are parallel to the lateral sides of the printed object are the lateral sides of the jacket.

The length of the lateral sides of the jacket, namely the width thereof, out of the sizes of the printing paper sheet required for printing for the jacket is determined by the sum of the length of the lateral sides of the front jacket portion (referred to as a front jacket width), the length of the lateral sides of the back jacket portion (referred to as a back jacket width) and the length of the lateral sides of the spine jacket portion (referred to as a spine jacket width). Out of the front jacket width, the back jacket width and the spine jacket width, the back jacket width and the spine jacket width, are both determined by the length of the lateral sides of the printed object to be subjected to case binding. For example, these widths are determined to be the same length as that of the lateral sides of the printed object to be subjected to the case binding or to be the same length thereas plus a predetermined length. Accordingly, operation unit 111 can calculate the front jacket width and the back jacket width, using the length of the lateral sides of the printed object.

Further, operation unit 111 performs operations for calculating the spine jacket width, using the signals inputted from suggestion reception unit 107 and the information inputted from second reading unit 108. Therefore, hereinafter, there will be described a concrete example of the flow of the processing by PC 1, and there will be described, in detail, particularly, the operations performed by operation unit 111 for calculating the spine jacket width.

Figure 5:
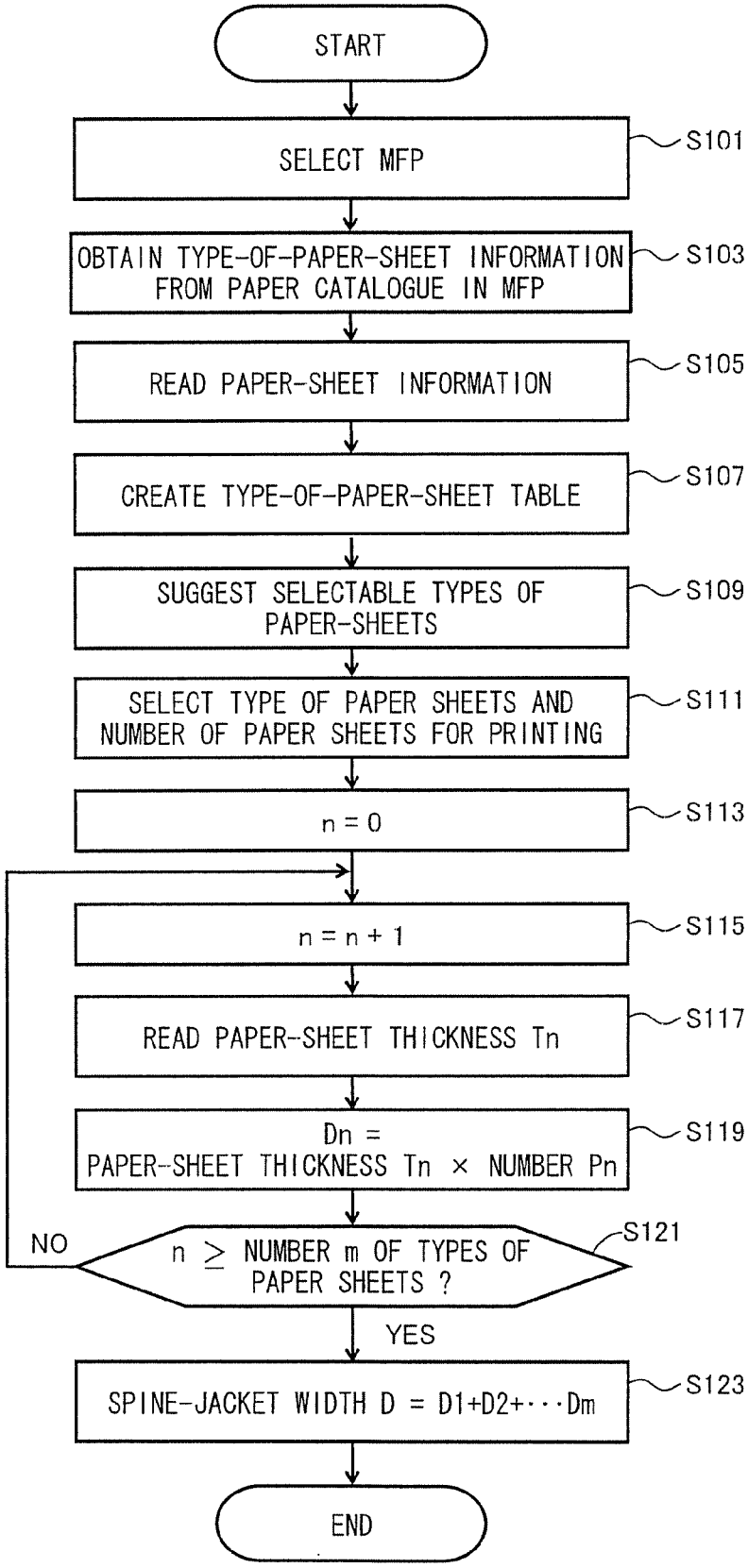
FIG. 5 is a flowchart illustrating a concrete example of the flow of processing in the PC included in the system according to the embodiment of the present invention.

FIG. 5 is a flow chart illustrating a concrete example of the flow of processing by PC 1. CPU 11 reads programs stored in ROM 15 and the like for controlling the respective units of PC 1 illustrated in FIG. 1 for causing the respective structures illustrated in FIG. 4 to function, which realizes the processing illustrated by the flow chart of FIG. 5. The processing illustrated by the flow chart of FIG. 5 is executed when operations for causing the MFP to perform case binding have been performed through input unit 18.

Referring to FIG. 5, in step S101, printer controller 19 receives a selection of an MFP to be caused to perform case binding, based on operation signals from input unit 18. When the system structure includes plural MFPs, a selection of an intended MFP 3, out of the plural MFPs, is received, in step S101.

In step S103, obtaining unit 101 accesses MFP 3 selected in step S101 and obtains information indicative of the types of printing paper sheets stored in MFP 3, namely the combined information about the sorts and the basis weights of the stored printing paper sheets. When the paper catalogue illustrated in FIG. 2 is stored in MFP 3, obtaining unit 101 obtains information indicative of the types of printing paper sheets of sheet sorts "Plain", "CoatedA", "Thick1" and "Thin".

Then, in step S105, first reading unit 103 reads a thicknesses of printing paper sheets corresponding to the aforementioned types read from MFP 3 in step S103, out of the paper-sheet information stored in the storage devices such as RAM 13. When PC 1 stores the paper-sheet information illustrated in FIG. 3, and the aforementioned information has been obtained in step S103, 0.085 mm, 0.121 mm, 0.255 mm and 0.075 mm are read out as the thicknesses of printing paper sheets of the sheet sorts "Plain", "CoatedA", "Thick1" and "Thin", respectively.

In step S107, creation unit 105 creates information indicative of the correspondence between the types of paper sheets and the thicknesses of the paper sheets, regarding the printing paper sheets stored in MFP 3 to be caused to perform case binding, from the types of paper sheets read, in step S103, from the paper catalogue in MFP 3 to be caused to perform case binding and from the thicknesses read, in step S105, fiom the paper-sheet information stored in PC 1 itself. In this case, concretely, it is assumed that a table indicative of the correspondence between the types of paper sheets and the thicknesses of the paper sheets is created, as information indicative of the correspondence. In the aforementioned example, a correspondence table illustrated in FIG. 6 is crated in step S107.

In step S109, suggestion reception unit 107 causes display unit 16 to display paper sheets which can be selected as paper sheets for use in printing for creating a printing object to be subjected to case binding by MFP 3 selected in step S101, based on the information created in step S107.

Figures 6, 7:
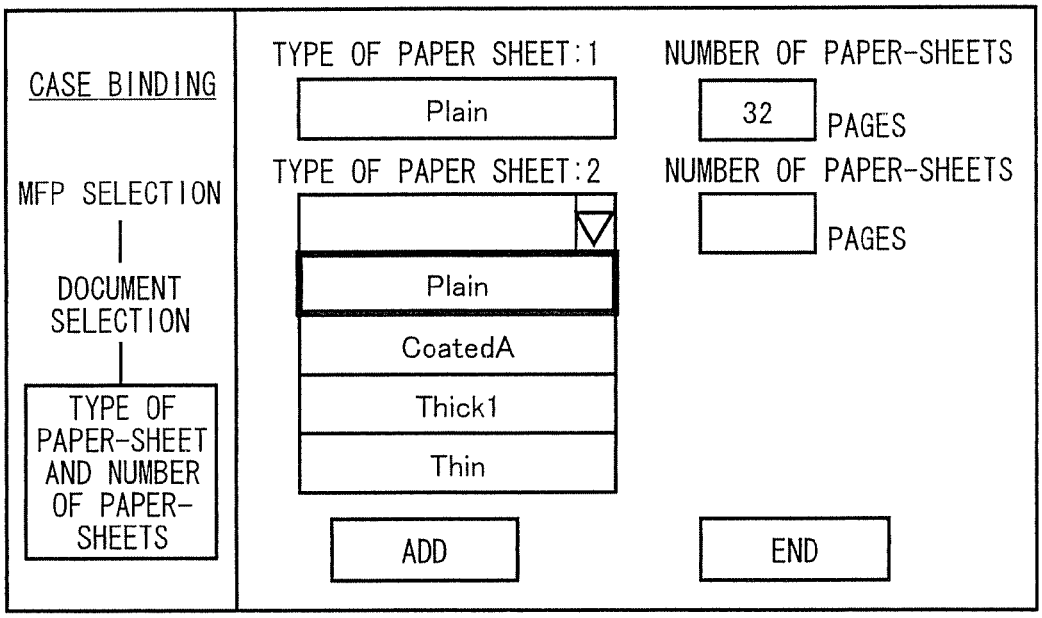
FIG. 6 is a diagram illustrating a concrete example of a correspondence table created in step S107 in the processing in FIG. 5.
FIG. 7 is a diagram illustrating a concrete example of a screen page displayed on the PC in step S109 in the processing in FIG. 5.
Figure 8A:
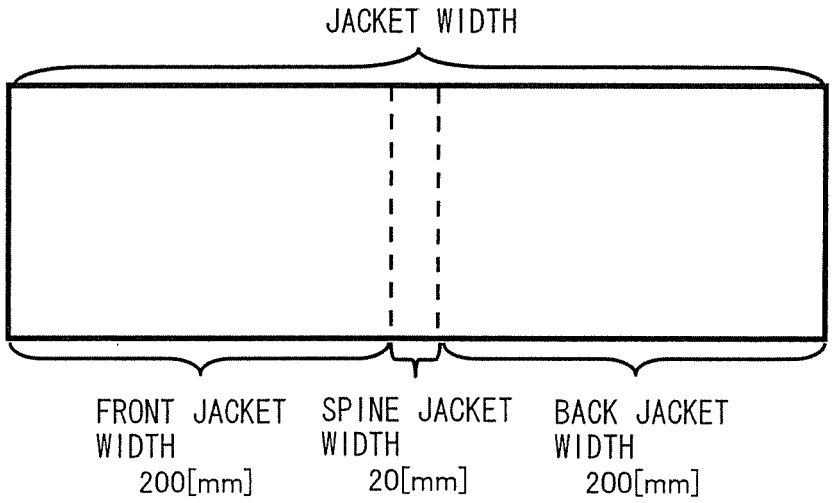
FIG. 8A PRIOR ART
FIG. 8A is a diagram describing a calculated width of a jacket.
Figure 8B:
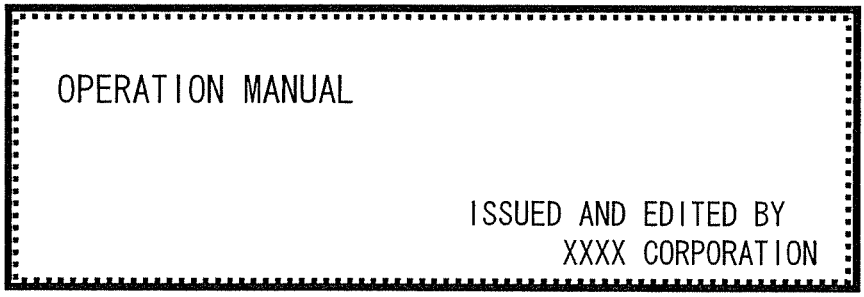
FIG. 8B PRIOR ART
FIG. 8B is a diagram describing the relationship between a printing paper sheet used for printing for a jacket and image data used for printing for the jacket, when the image data is applied to the printing paper sheet.

FIG. 7 illustrates a concrete example of a screen page displayed on display unit 16 in step S109. In the aforementioned example, MFP 3 selected in step S101 stores printing paper sheets of sheet sorts "Plain", "CoatedA", "Thick1" and "Thin". Further, MFP 3 does not store paper sheets of the same sheet sort which have different thicknesses. Therefore, the types of paper sheets can be indicated by their paper sheet sorts. In the example of FIG. 7, the paper sheet sorts "Plain", "CoatedA", "Thick1" and "Thin" are suggested as options for types of paper sheets for use in printing. In a case where the selected MFP stores paper sheets of the same paper-sheet sort which have different thicknesses, it is preferable that information about the paper-sheet sorts and the basis weights, as the types of paper sheets, is suggested as options for types of paper sheets for use in printing. Further, in step S109, an input of a number of paper sheets to be used for printing is received, for each type of paper sheets, through the screen page of FIG. 7.

In steps S113 to S123, operation unit 111 performs operations for calculating the spine jacket width, in performing case binding on the printed object resulted from the printing of image data with the paper-sheet types and the numbers of paper sheets selected in step S111. More specifically, operation unit 111 initializes a variable number n indicative of the number of selected types of paper sheets to 0 in step S113, then increments the variable number n by 1 in step S115. In step S117, second reading unit 108 reads a thickness Tn of the paper-sheet type corresponding to this variable number, from the information indicative of the correspondence between the paper-sheet types and the paper-sheet thicknesses which has been created in step S107 and stored in the predetermined areas of the storage devices. Then, in step S109, operation unit 111 multiplies thickness Tn read in step S117 by the number Pn of printing paper sheets of the paper-sheet type corresponding to this variable number which has been inputted in step S111 to obtain a spine jacket width Dn of the printed object resulted from the printing with the paper-sheet type corresponding to this variable number, out of the entire printed object. Steps S115 to S119 are repeated a number of times corresponding to the number m of the paper-sheet types selected in step S111 (Yes in step S121), thereby providing spine jacket widths Dn of the printed objects resulted from the printing with the respective paper-sheet types selected in step S111.

In step S123, operation unit 111 sums up all spine jacket widths Dn resulted from the processing to provide a spine jacket width D, wherein the number of the spine jacket widths Dn resulted from the processing is m.

With reference to the above example, the aforementioned processing in steps S113 to S123 will be described in detail.

In this case, it is assumed that a job for causing MFP 3 to perform printing for creating a printed object to be subjected to case binding is constituted by the following types of sheets.

The type of the first paper sheet (Slip sheet): Plain

The type of the second paper sheet to the 101-th paper sheet (Normal sheets) CoatedA The type of the 102-th paper sheet (Slip sheet): Plain The type of the 103-th to 132-th paper sheets (Normal sheets): Plain In this case, in step S111, selections of a paper-sheet type (m=1) having a paper-sheet sort of "Plain" and a basis weight of "68 g/m$^2$" and a paper-sheet type (m=2) having a paper-sheet sort of "CoatedA" and a basis weight of "81 g/m$^2$" are received, as types of paper sheets for used in printing, according to user's operations. Further, as numbers of paper sheets to be used in printing, an input of 32 pages (=1+1+30) is received for the former paper-sheet type, and an input of 100 pages is received for the latter paper-sheet type.

In this case, regarding the aforementioned former paper sheet type (m=1) indicated as the sort "Plain", in step S117, a thickness T1 of 0.085 mm is read from the correspondence table illustrated in FIG. 6 and, in step S119, a spine jacket width D1 is obtained based on the calculation equation D1=0.085×32 mm, for this sheet type.

Further, regarding the aforementioned paper-sheet type (m=2) indicated as the sort "CoatedA", in step S117, a thickness of 0.121 mm is read from the correspondence table illustrated in FIG. 6 and, in step S119, a spine jacket width D2 is obtained based on the calculation equation D1=0.121×100 mm, for this sheet type.

Accordingly, in step S123, spine jacket width D is determined to be 14.82 mm, through the calculation based on the calculation equation D=D1+D2.

As described above, PC 1 reads the paper catalogue from MFP 3 and calculates the spine jacket width, using the thicknesses of paper sheets to be actually used for printing which are actually stored in MFP 3 which is caused to perform printing. This enables determining, through calculations, a spine jacket width which is closer to the actual thickness of the printed object. Further, this enables calculating the spine jacket width more efficiently, in comparison with processing for receiving selections of paper sheets to be used for printing, using only the paper-sheet information stored in PC 1.

Further, in the example, there has been described the processing for executing the processing from step S101, when the user has performed operations for causing case binding. However, preferably, the processing in steps S103 to S107, out of steps S101 to S123, are preliminarily executed at different timings from the timings, and the results of these steps are preliminarily stored in predetermined areas of the storage devices in PC 1.

Such different timings can be, for example, the timing when this structure has been structured, timings when a new MFP has been connected to this system, timings at predetermined time intervals, timings when changes have been made to the paper catalogue in the MFP. More preferably, in a case where the system includes plural MFPs, a correspondence table as illustrated in FIG. 6 is created for each MFP and is preliminarily stored in predetermined areas in the storage devices in PC 1. Further, if an MFP to be used for printing is selected in step S101, suggestion reception unit 107 makes a reference to the correspondence table for the selected MFP, out of the correspondence tables stored therein, and causes display unit 16 to display a screen page as illustrated in FIG. 7, in step S109. This enables reading the thicknesses of the selected printing paper sheets more efficiently, thereby enabling calculating the spine jacket width more efficiently, in comparison with a case where correspondence tables as illustrated in FIG. 6 are not created.

Further, as another example, it is possible to eliminate the processing in step S107. In this case, printer controller 19 is not required to include creation unit 105. Further, first reading unit 103 and second reading unit 108 can be formed to be a single reading unit. Concrete processing which is performed in this case will be described. That is, in step S109, suggestion reception unit 107 causes display unit 16 to display the types of paper sheets which have been obtained in step S103 from the paper catalogue in the selected MFP, as options for paper sheets which can be selected as paper sheets for use in printing for a printed object to be subjected to case binding.

Then, in step S117, the reading unit constituted by first reading unit 103 and second reading unit 108 reads the thicknesses of printing paper sheets corresponding to the paper-sheet types selected in step S111, out of the paper-sheet information stored in the storage devices in PC 1. By doing this, it is possible to eliminate the processing for creating a correspondence table as illustrated in FIG. 6. Further, this can eliminate the necessity of providing a storage area required for storing the correspondence table.

As described above, the front jacket width and the back jacket width are both determined by the length of the lateral sides of the printed object to be subjected to case binding. In this case, it is assumed that PC 1 has preliminarily stored the lengths of the lateral sides of printing paper sheets, as well as the paper-sheet information illustrated in FIG. 3. Therefore, operation unit 111 can read the length of the lateral sides of the printed object based on the paper-sheet sizes selected similarly to in step S111 and, on the basis thereof, can determine the front jacket width and the back jacket width. Similarly, operation unit 111 can also obtain the length of the lateral sides of the jacket. Further, the width of the jacket can be calculated by adding the spine jacket width obtained through the calculations to the front jacket width and the back jacket width. Namely, operation unit 111 can calculate the lengths of the longitudinal and lateral sides of the jacket, namely the sizes of the jacket, through the aforementioned operations.

Figure 9A:
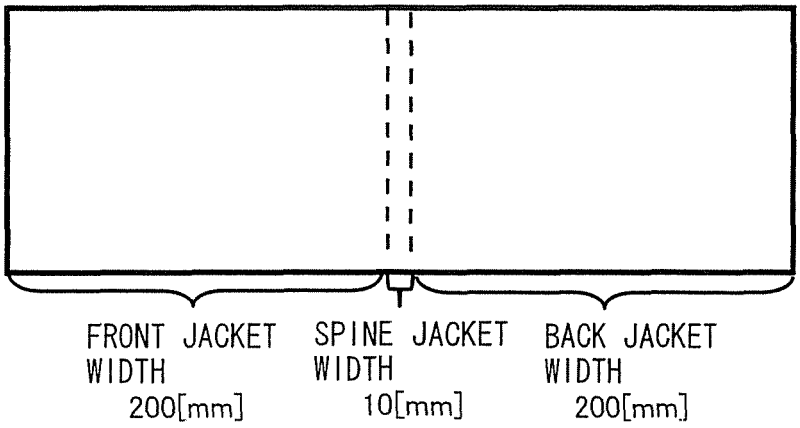
FIG. 9A PRIOR ART
FIG. 9A is a diagram describing a calculated width of a jacket.
Figure 9B:
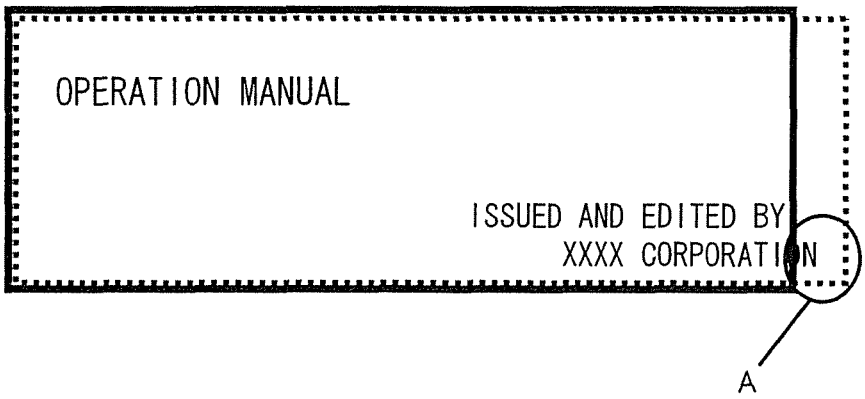
FIG. 9B PRIOR ART
FIG. 9B is a diagram describing the relationship between a printing paper sheet used for printing for a jacket and image data used for printing for the jacket, when the image data is applied to the printing paper sheet.
Figure 10A:
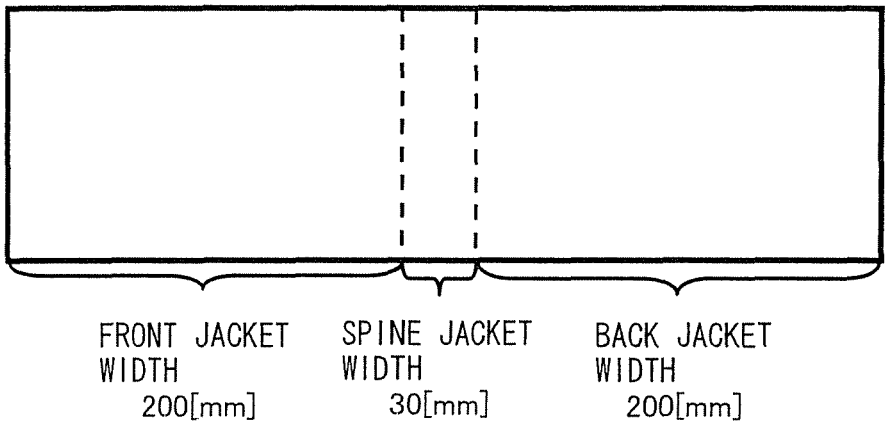
FIG. 10A PRIOR ART
FIG. 10A is a diagram describing a calculated width of a jacket.
Figure 10B:
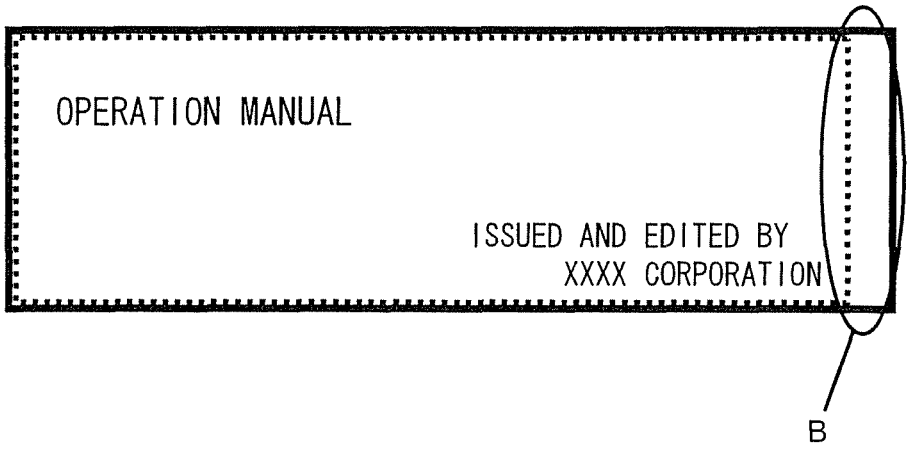
FIG. 10B PRIOR ART
FIG. 10B is a diagram describing the relationship between a printing paper sheet used for printing for a jacket and image data used for printing for the jacket, when the image data is applied to the printing paper sheet.

After operation unit 111 calculates the sizes of the jacket, printer controller 19 outputs, to MFP 3 through network 2, control signals for causing MFP 3 to perform printing for the jacket with the sizes. Accordingly, MFP 3 receives a specification of jacket sizes including a spine jacket width calculated based on the thicknesses of printing sheets to be used for printing which are actually stored in this MFP 3. Accordingly, MFP 3 performs case binding using, as a jacket, a sheet with sizes conforming to the control signals from PC 1, so that the sizes of the jacket conform to the sizes of the printed object subjected to the case binding. Further, MFP 3 prints image data on a printing paper sheet with sizes conforming to the control signals from PC 1 as the jacket, which prevents disagreement between the sizes of the image data and the sizes of the printing sheet, as illustrated in FIG. 9B and FIG. 10B. Further, even when a job for printing for creating a printed object to be subjected to case binding is constituted by plural sorts of printing paper sheets, it is possible to calculate the spine jacket width accurately. As a result, this system can attain beautiful case binding.

In the aforementioned example, there has been described a case where the PC which is the control apparatus connected to the MFP as the image forming apparatus performs the aforementioned operations. Further, in FIG. 1, there is illustrated the control apparatus as being a different apparatus from the image forming apparatus. However, the control apparatus can either be entirely included in the image forming apparatus or be at least partially included therein. In this case, CPU 31 in MFP 3 reads and executes programs stored in storage devices such as ROM 33 to structure, in CPU 31 and the like, at least a unit of the structure illustrated in FIG. 4. Further, in a case where the system includes plural image forming apparatuses, one of the plural image forming apparatuses can include a control apparatus, such that the image forming apparatus including the control apparatus can control the other image forming apparatuses including no control apparatus. In any of these cases, the aforementioned operations can be realized with the structure illustrated in FIG. 4.

The structure of PC 1 is not limited to the structure illustrated in FIG. 1 and can include other structures. Further, the control apparatus is not limited to a PC and can be constituted by other apparatus or can be realized by parts of other apparatuses. Similarly, the structure of MFP 3 is not limited to the structure illustrated in FIG. 1 and can further include other structures. Further, the image forming apparatus is not limited to an MFP and can be constituted by other apparatuses. In the aforementioned description, the image forming apparatus is caused to perform printing for creating a jacket for use in case binding. However, the image forming apparatus is not necessarily required to perform printing for creating jackets and is only required to identify at least sheets to be used as jackets for case binding by being controlled by the control apparatus. Namely, the image forming apparatus and the apparatus which performs post-processing can be constituted by different apparatuses, such that the control apparatus controls both the apparatuses. Further, in this case, at least a part of the control apparatus can be included in the apparatus which performs the post-processing.

Further, it is also possible to provide a program for causing a computer to execute the aforementioned operations. This program can be provided as program products by being recorded in computer-readable recording mediums, such as flexible disks accompanied by computers, CD-ROMs (Compact Disk-Read Only Memories), ROMs, RAMs and memory cards. Also, this program can be supplied by being recorded in recording mediums such as hard disks incorporated in computers. Also, the program can be supplied through downloading through networks.

Further, a program according to the present invention can be structured to call up necessary modules, out of program modules supplied as parts of an operating system (OS) of a computer, with a predetermined arrangement at predetermined timings for executing processing. In this case, the program itself does not include the modules and executes the processing, in cooperation with the OS. Such a program including no modules can be also included in the program according to the present invention.

Also, the program according to the present invention can be supplied by being incorporated in a part of another program. Such another program can be, for example, a printer driver installed in a personal computer. In this case, similarly, the program itself does not include the modules included in the aforementioned another program and executes processing in cooperation with the aforementioned another program. Such a program incorporated in another program can be also included in the program according to the present invention.

A supplied program product is executed by being installed in a program storage unit such as a hard disk. Further, the program product includes the program itself and the recording medium storing the program.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A control apparatus which controls an image forming apparatus having a function of performing spine-jacketed book binding processing on a printed object, the control apparatus comprising:

a first storage unit which stores first correspondence information indicative of the correspondence between information identifying printing paper sheets and basis weights of said printing paper sheets;

an obtaining unit which obtains information identifying currently stored printing paper sheets, from said image forming apparatus;

a reception unit which receives a selection of printing paper sheets for use in printing image data, out of said information identifying the currently stored printing paper sheets which has been obtained from said image forming apparatus by said obtaining unit, and a number of said printing paper sheets to be used for printing;

an identification unit which identifies a thickness of said selected printing paper sheets, based on said first correspondence information, said selection of which having been received by said reception unit;

a calculation unit which calculates a spine jacket width in performing jacketed-book binding processing on the printed object resulted from printing said image data on said printing paper sheets, based on the value resulted from multiplication of the thickness of said printing paper sheets identified by said identification unit by the number of paper sheets to be used for printing which has been received by said reception unit; and an output unit which outputs, to said image forming apparatus, a control signal including said spine jacket width calculated by said calculation unit.

2. The control apparatus according to claim 1, wherein said reception unit receives selections of first printing paper sheets and second printing paper sheets, as printing paper sheets for use in printing said image data, and a number of said first printing paper sheets to be used for printing and a number of said second printing paper sheets to be used for printing, and said calculation unit calculates said spine jacket width, based on the value resulted from the multiplication of a thickness of said first printing paper sheets by the number of said first printing paper sheets to be used for printing, and the value resulted from the multiplication of a thickness of said second printing paper sheets by the number of said second printing paper sheets to be used for to printing.

3. The control apparatus according to claim 1, further comprising a creation unit which creates, regarding the printing paper sheets currently stored in said image forming apparatus, second correspondence information indicative of the correspondence between information identifying said printing paper sheets and the thicknesses of said printing paper sheets, from said first correspondence information and from the information identifying the printing paper sheets currently stored in said image forming apparatus which has been obtained by said obtaining unit, wherein said identification unit includes a reading unit which reads the thickness of said selected printing paper sheets, from said second correspondence information.

4. The control apparatus according to claim 3, wherein said creation unit creates said second correspondence information for each of a plurality of image forming apparatuses, said control apparatus further comprises a specification unit which specifies an image forming apparatus to be caused to perform said jacketed-book binding processing, out of said plurality of image forming apparatuses, said reading unit reads the thickness of said selected printing paper sheets, out of said second correspondence information for the image forming apparatus specified by said specification unit, out of the second correspondence information for said plurality of image forming apparatuses.

5. The control apparatus according to claim 3, further comprising a second storage unit which stores said second correspondence information, wherein said reading unit reads the thickness of said selected printing paper sheets, out of said second correspondence information stored in said second storage unit.

6. The control apparatus according to claim 1, wherein said identification unit includes a reading unit which reads the thickness of said selected printing sheets, out of said first correspondence information.

7. A system comprising an image forming apparatus and a control apparatus which controls said image forming apparatus, said image forming apparatus comprising:

a storage unit which stores information identifying stored printing paper sheets; and a post-processing unit which performs spine-jacketed book binding processing on a printed object, according to a control signal from said control apparatus;

said control apparatus comprising:

a first storage unit which stores first correspondence information indicative of the correspondence between information identifying printing paper sheets and basis weights of said printing paper sheets, an obtaining unit which obtains the information identifying the printing paper sheets currently stored in said image forming apparatus which is stored in said storage unit in said image forming apparatus, a reception unit which receives a selection of printing paper sheets for use in printing image data and a number of said printing paper sheets to be used for printing, out of said information identifying the printing paper sheets currently stored in said image forming apparatus which has been obtained by said obtaining unit, an identification unit which identifies the thickness of said selected printing paper sheets, based on said first correspondence information, the selection of which having been received by said reception unit, a calculation unit which calculates a spine jacket width in performing jacketed-book binding processing on the printed object resulted from said image data on said printing paper sheets, based on the value resulted from multiplication of the thickness of said printing paper sheets identified by said identification unit by the number of paper sheets to be used for printing which has been received by said reception unit, and an output unit which outputs, to said image forming apparatus, said control signal including said spine jacket width calculated by said calculation unit.

8. A storage medium storing a program for causing a computer to execute calculations for a spine jacket width included in the width of a jacket to be used in performing spine-jacketed book binding processing on a printed object:

wherein said computer comprises a storage unit which stores first correspondence information indicative of the correspondence between information identifying printing paper sheets and basis weights of said printing paper sheets, and said program causes the computer to execute the steps of;

obtaining information identifying printing paper sheets currently stored in an image forming apparatus to be caused to perform said book binding processing, receiving a selection of printing paper sheets for use in printing image data and a number of said printing paper sheets to be used for printing, out of said information identifying the printing paper sheets currently stored in said image forming apparatus, reading at least a thickness of said selected printing paper sheets, from said storage unit, identifying the thickness of said selected printing paper sheets, based on said first correspondence information, and calculating a spine jacket width in performing jacketed-book binding processing on the printed object resulted from printing said image data on said printing paper sheets, based on the value resulted from multiplication of the identified thickness of said printing paper sheets by the received number of paper sheets to be used for printing.

9. A method for calculating a spine jacket width with a control apparatus which controls an image forming apparatus having a function of performing spine-jacketed book binding processing on a printed object:

wherein said control apparatus comprises a first storage unit which stores first correspondence information indicative of the correspondence between information identifying printing paper sheets and basis weights of said printing paper sheets, and said calculating method comprises the steps of;

obtaining information identifying printing paper sheets currently stored in an image forming apparatus to be caused to perform said book binding processing, receiving a selection of printing paper sheets for use in printing image data and a number of said printing paper sheets to be used for printing, out of said information identifying the printing paper sheets currently stored in said image forming apparatus, reading at least a thickness of said selected printing paper sheets from said first storage unit, identifying the thickness of said selected printing paper sheets, based on said first correspondence information, and calculating a spine jacket width in performing jacketed-book binding processing on the printed object resulted from printing said image data on said printing paper sheets, based on the value resulted from multiplication of the identified thickness of said printing paper sheets by the received number of paper sheets to be used for printing.

10. The method for calculating the spine jacket width according to claim 9, wherein said step of receiving a selection of said printing paper sheets and a number of said printing paper sheets to be used for printing comprises receiving selections of first printing paper sheets and second printing paper sheets, as printing paper sheets for use in printing said image data, and also receiving a number of said first printing paper sheets to be used for printing and a number of said second printing paper sheets to be used for printing, and said step of calculating said spine jacket width comprises calculating the spine jacket width, based on the value resulted from multiplication of a thickness of said first printing paper sheets by the number of said first printing paper sheets to be used for printing, and the value resulted from multiplication of a thickness of said second printing paper sheets by the number of said second printing paper sheets to be used for printing.

11. The method for calculating the spine jacket width according to claim 9, further comprising the step of creating, regarding the printing paper sheets stored in said image forming apparatus, second correspondence information indicative of the correspondence between said information identifying said printing paper sheets and the thicknesses of said printing paper sheets, from said first correspondence information and from said information identifying the printing paper sheets stored in said image forming apparatus which has been obtained in the step of obtaining the information identifying said printing sheets, wherein said step of identifying the thickness of said selected printing paper sheets comprises the step of reading the thickness of said selected printing paper sheets, from said second correspondence information.

12. The method for calculating the spine jacket width according to claim 11, wherein said step of creating said second correspondence information comprises creating said second correspondence information for each of a plurality of image forming apparatuses, said calculating method further comprises the step of specifying an image forming apparatus to be caused to perform said jacketed book binding processing, out of said plurality of image forming apparatuses, wherein said step of reading the thickness of said printing paper sheets comprises reading the thickness of said selected printing paper sheets, out of said second correspondence information for said specified image forming apparatus, out of said second correspondence information for said plurality of image forming apparatuses.

13. The method for calculating the spine jacket width according to claim 11, wherein said control apparatus further comprises a second storage unit which stores said second correspondence information, and said step of reading the thickness of said printing paper sheets comprises reading the thickness of said selected printing paper sheets, out of said second correspondence information stored in said second storage unit.

14. The method for calculating the spine jacket width according to claim 9, wherein said step of identifying the thickness of said printing paper sheets comprises the step of reading the thickness of said selected printing paper sheets from said first correspondence information.

* * * * *